United States Patent [19]

Moriyoshi

[11] 4,202,311

[45] May 13, 1980

[54] MEANS FOR RESILIENTLY CONNECTING AN OIL PAN TO AN ENGINE BODY

[75] Inventor: Hiroshi Moriyoshi, Aki, Japan

[73] Assignee: Toyo Kogyo Co., Ltd., Hiroshima, Japan

[21] Appl. No.: 928,302

[22] Filed: Jul. 26, 1978

[30] Foreign Application Priority Data

Jul. 27, 1977 [JP] Japan ..... 52-101008[U]
Aug. 20, 1977 [JP] Japan ..... 52-111172[U]

[51] Int. Cl.[2] ..... F02F 7/00

[52] U.S. Cl. ..... 123/195 C; 123/198 E; 277/235 B

[58] Field of Search ..... 123/195 C, 198 E, 195 R; 184/106; 180/69.1; 277/235 B

[56] References Cited

U.S. PATENT DOCUMENTS

| | | | |
|---|---|---|---|
| 1,737,466 | 11/1929 | Lynd | 123/195 C |
| 3,063,439 | 11/1962 | Kessel | 123/90.38 |
| 3,678,914 | 7/1972 | Vulliamy | 123/195 C |
| 3,695,386 | 10/1972 | Thien et al. | 123/195 C |
| 3,822,763 | 7/1974 | Adams et al. | 123/198 E |
| 3,869,859 | 3/1975 | Thornburgh | 123/198 E |
| 3,936,059 | 2/1976 | Gordon | 277/235 B |
| 4,066,058 | 1/1978 | Anderkay | 123/198 E |
| 4,118,041 | 10/1978 | Futamura | 277/235 B |

OTHER PUBLICATIONS

Thien, "The Use of Specially Designed Covers and Shields to Reduce Diesel Engine Noise": SAE Publication 730244 from International Automotive Engineering Congress of Jan. 8-12, 1973; pp. 957 & 958.

*Primary Examiner*—Charles J. Myhre
*Assistant Examiner*—Craig R. Feinberg
*Attorney, Agent, or Firm*—Fleit & Jacobson

[57] ABSTRACT

Apparatus for resiliently mounting an oil pan to an engine crankcase, which eliminates oil pan vibration and prevents oil leakage. A first resilient member is located between the crankcase and the pan and a second resilient member is located between the pan and a depressing plate. The second resilient member has a coefficient of elasticity greater than that of the first resilient member, so as to resist compressive deformation. The depressing plate is provided with an upwardly bent edge which also aids in preventing compressive deformation of the second resilient member.

6 Claims, 4 Drawing Figures

MEANS FOR RESILIENTLY CONNECTING AN OIL PAN TO AN ENGINE BODY

The present invention relates to means for resiliently connecting an oil pan to a body such as a cylinder block or crankcase of an internal combustion engine in such a manner that engine vibrations are prevented from being transmitted from the engine body to the oil pan.

It has been a conventional practice to install an oil pan on an engine body at the bottom portion thereof with a resilient member interposed therebetween in order to suppress vibrations of and resultant noise from the oil pan. It has also been proposed to dispose an additional resilient member between the oil pan and heads of bolts connecting the oil pan to the engine body in order to ensure the effects of suppressing the oil pan vibrations. Examples of such arrangements are disclosed by the SAE report 730,244.

In the known arrangement, it is required to adjust bolt tightening force in such a manner that the resilient member is compressed between the oil pan and the engine body with an appropriate compressive force which is sufficient to prevent leakage of oil but does not have any adverse effect on the resiliency or vibration absorbing property of the resilient member. In the conventional arrangement including a first resilient member disposed between the oil pan and the engine body as well as a second resilient member between the oil pan and the heads of the connecting bolts, the resilient members have been of the same coefficient of resiliency and have been tightened under the same force. In this arrangement, problems have been encountered in that the weight of the oil pan is supported by the engine body through the second resilient member and the connecting bolts so that a further compressive force is applied to the second resilient member while the compressive force is decreased in the first resilient member resulting in possible oil leakage between the engine body and the oil pan.

Further, in the conventional arrangements, in determining the manner of resiliently installing the oil pan on the engine body, careful considerations have not been made with respect to actual use of the automobile on which the engine is mounted. It has been recognized that, when the automobile is operated on a rough road, vertical vibrations of the automobile produce an inertia force of up to 3 to 4 g in the oil pan and this dynamic force is superimposed on the aforementioned static force due to the weight of the oil pan. Thus, the compressive force is further decreased in the first resilient member and further increased in the second resilient member.

It is therefore an object of the present invention to provide means for installing an oil pan on an engine body such as an engine block or crankcase in such a manner that vibrations in the engine body are substantially absorbed before they are transmitted to the oil pan simultaneously preventing oil leakage between the engine block and the oil pan.

Another object of the present invention is to provide means for installing an oil pan on an engine body through a plurality of connecting bolts with a first resilient member interposed between the engine body and the oil pan and a second resilient member between the oil pan and the connecting bolts for absorbing vibrations being transmitted from the engine body to the oil pan and at the same time preventing oil leakage between the engine body and the oil pan.

A further object of the present invention is to provide means for installing an oil pan on an engine body in such a manner that the oil pan is supported resiliently in both vertical and horizontal directions.

According to the present invention, the above and other objects can be accomplished by an internal combustion engine including an engine body having a lower end defined by a periphery, an oil pan having a periphery connected with the periphery of the engine body by means of a plurality of connecting bolts inserted through the oil pan into the engine body with bolt heads located beneath the oil pan, first resilient means disposed between the engine body and the oil pan and extending along said peripheries, second resilient means disposed between the oil pan and the heads of the connecting bolts, said second resilient means having coefficient of elasticity greater than that of the first resilient means.

According to the feature of the present invention, since the second resilient means has coefficient of elasticity greater than that of the first resilient means, the deformation of the second resilient means under the weight of the oil pan is not so significant as in the conventional arrangement. Therefore, the compression on the first resilient means is not decreased so significantly that the sealing between the engine body and the oil pan. The second resilient means may be constituted by a single member extending along the periphery of the oil pan.

In order that the second resilient means has the coefficient of elasticity greater than that of the first resilient means, the former may be made of a material which is of a greater hardness than the material of the latter. Alternatively, the second resilient means may be made thinner than the first resilient means. Further, the second resilient means may have longer pressure receiving area than the first resilient means.

It is preferable that the second resilient means has coefficient of elasticity which is 2 to 4 times as great as that of the first resilient means. With the elastic coefficient of the second resilient means smaller than 2 times the elastic coefficient of the first resilient means, oil leakage cannot be positively prevented at the connection between the engine body and the oil pan. However, where the elastic coefficient of the second resilient means is more than 4 times the elastic coefficient of the first resilient means, vibration absorbing property of the second resilient means will be significantly decreased.

According to a further aspect of the present invention, at least one of the first and second resilient means is fixed to the oil pan and provided with bolt holes which are smaller in diameter than bolt holes formed in the oil pan so that the bolts are in intimate contact with said one resilient means but prevented from contacting with the oil pan.

The above and other objects and features of the present invention will become apparent from the following descriptions of the preferred embodiments taking reference to the accompanying drawings, in which.

Figure 1:
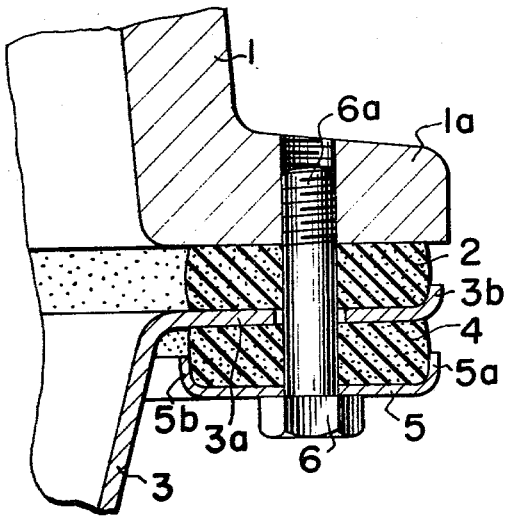
FIG. 1 is a fragmentary sectional view showing the connection between the cylinder block and the oil pan embodying the feature of the present invention.

Referring now to the drawings, particularly to FIG. 1, there is shown a lower part of a cylinder block 1 of an internal combustion engine 1. The cylinder block 1 is formed at the lower end with a peripheral flange 1*a* with which an oil pan 3 is connected. The oil pan 3 has a peripheral flange 3*a* which is adapted to be brought into mating engagement with the flange 1*a* on the cylinder block 1 with an intervention of an upper resilient member 2 which may be made of a rubber material. The resilient member 2 extends throughout the circumferential lengths of the flangers 1*a* and 3*a*.

Beneath the flange 3*a* of the oil pan 3, there is located a lower resilient member 4 which is also made of a rubber material and extends along the peripheral flange 3*a*. In order to support the lower surface of the resilient member 4, there is provided a depressing plate 5 which has upwardly bent edges 5*a* and 5*b* so that the member 4 is held in position by these edges 5*a* and 5*b*. The peripheral flange 3*a* of the oil pan 3 is also formed with an upwardly bent edge 3*b* so that the resilient member 2 is maintained against displacement by the edge 3*b*.

A suitable number of connecting bolts 6 are inserted through the plate 5, the lower resilient member 4, the flange 3*a* of the oil pan 3 and the upper resilient member 2 into the flange 1*a* of the cylinder block 1 and threadably engaged at a threaded end 6*a* with the flange 1*a*.

The lower resilient member 4 is made of a material having a hardness greater than that of the upper resilient member 2 so that the coefficient of elasticity of the lower resilient member 4 is greater than that of the upper resilient member 2. The upper resilient member 2 therefore has a smaller hardness as compared with the lower resilient member 4 and adapted to be compressed between the flange 1*a* of the cylinder block 1 and the flange 3*a* of the oil pan 3 with an appropriate pressure so that the resilient member 2 is sealingly engaged with the flanges 1*a* and 3*a*. In determining the coefficients of elasticity of the upper and lower resilient members 2 and 4, considerations must be made of the compressive deformation of the lower resilient member under the weight of the oil pan and the oil contained therein as well as under the inertia force due to vertical vibrations of the vehicle which may be produced when it is operated on rough roads.

Requirement is that, even when such compressive deformation is produced in the lower resilient member 4, the pressure on the upper resilient member 2 is maintained within such a limit in that the vibration absorbing property of the upper resilient member 2 can well be reserved. Thus, it is preferably that the coefficient of resiliency of the lower member 4 is 2 to 4 times as great as that of the upper resilient member 2.

The connecting bolts 6 may have threaded portions 6*a* of a predetermined or controlled length so that only a controlled pressure is applied to the resilient members 2 and 4 when the bolts 6 are fully tightened with a predetermined tightening torque. The upwardly bent edge 3*b* of the flange 3*a* provides a further advantage in that it prevents oil to leak along the interface between the resilient member 2 and the flange 3*a*.

In the arrangement shown in FIG. 1, it will be noted that the oil pan 3 is resiliently supported on the cylinder block 1 through the members 2 and 4 so that any vibration in the cylinder block 1 is substantially absorbed by the resilient members 2 and 4 before it is transmitted to the oil pan 3. Further, since the lower resilient member 4 is of a relatively high coefficient of elasticity, even when a downwardly directed inertia force is produced in the oil pan and applied together with the weight of the oil pan and the oil contained therein to the lower resilient member 4, it is possible to limit the downward displacement of the oil pan 3 which may be produced due to the possible compressive deformation of the lower resilient member 4. It is therefore possible to eliminate any possibility that the compressive force in the upper resilient material be decreased due to the displacement of the oil pan to the extent that oil may leak along the interfaces between the flanges 1*a* and 3*a* and the upper resilient member 2.

Figure 2:
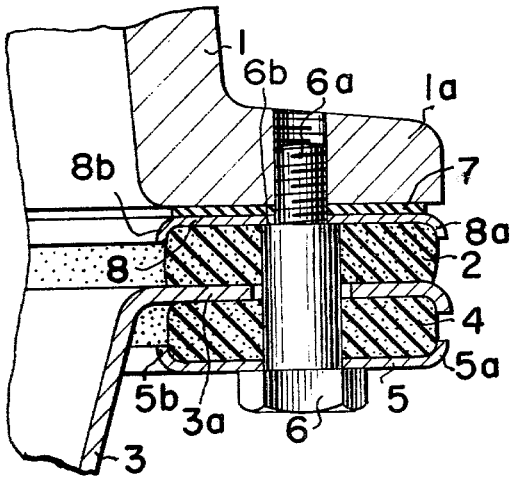
FIG. 2 is a fragmentary sectional view showing another embodiment of the present invention.

Referring now to FIG. 2, the embodiment shown therein is substantially identical to that shown in FIG. 1 so that corresponding parts are designated by the same reference numerals as in FIG. 1. In this embodiment, a holding plate 8 is placed on the upper surface of the upper resilient member 2 and a packing 7 is disposed between the flange 1*a* of the cylinder block 1 and the plate 8. The plate 8 has downwardly bent outer and inner edges 8*a* and 8*b* so that the upper resilient member 2 is held in position by these edges 8*a* and 8*b*. The packing 7 and the plate 8 extend circumferentially of the flanges 1*a* and 3*a* throughout the circumferential lengths thereof.

Each of the bolts 6 has a threaded portion 6*a* which is smaller in diameter than the shank portion so that a shoulder 6*b* is formed between the shank portion and the threaded portion 6*a*. The bolt 6 is inserted at the threaded portion 6*a* into the flange 1*a* of the engine body 1 with the shoulder portion 6*b* in abutting engagement with the plate 8. Thus, the packing 7 is compressed between the flange 1*a* of the engine block 1 and the shoulder portion 6*b* of the bolts 6 to provide oil-tight seal. By providing the shoulder portion 6*b* on the bolt 6, it is possible to adjust the compressive force on the resilient members 2 and 4 at an appropriate value simply by tightening the bolt 6. It is of course possible to provide a collar or sleeve around the shank of the bolt for determining the compressive force on the resilient members 2 and 4.

As in the previous embodiment, the lower resilient member 4 is made of a material of a higher hardness than the upper resilient member so that the former has a higher coefficient of elasticity than the latter. Therefore, it is possible to decrease the compressive deformation of the lower resilient member under the static and dynamic loads on the oil pan and to prevent substantial decrease in the compresson on the upper resilient member.

Figure 3:
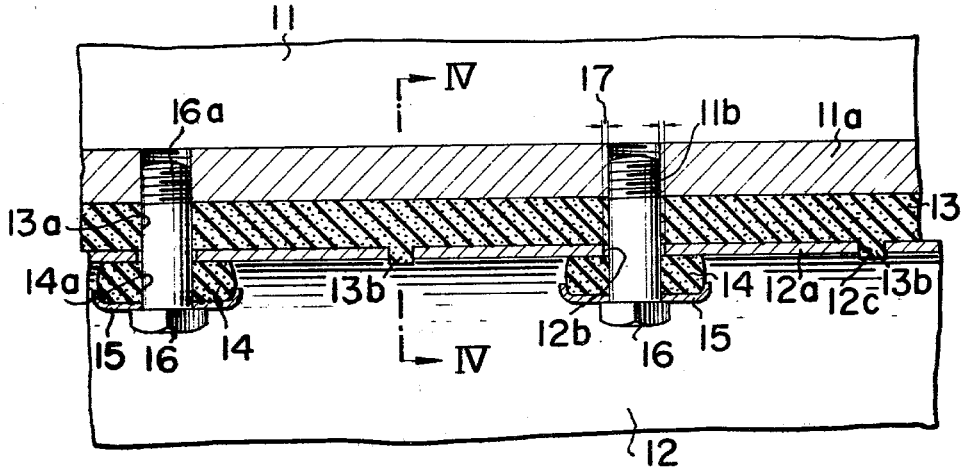
FIG. 3 is a sectional view taken along the peripheral portions of the cylinder block and the oil pan for showing a further embodiment of the present invention.
Figure 4:
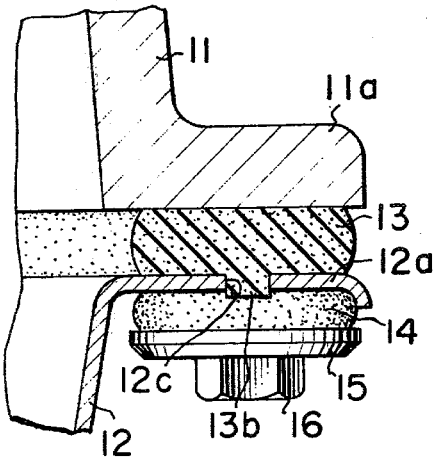
FIG. 4 is a sectional view taken along the line IV—IV in FIG. 3.

Referring to FIGS. 3 and 4 which show a further embodiment of the present invention, there is shown a cylinder block 11 having a lower peripheral flange 11*a* and an oil pan 12 having an upper peripheral flange 12*a* connected with the flange 11*a* of the cylinder block 11 with an upper resilient member 13 interposed therebetween. The flange 11*a* of the cylinder block 11 is formed with a plurality of circumferentially spaced threaded holes 11*b* and the flange 12*a* of the oil pan 12 is formed with a plurality of bolt holes 12*b* respectively aligned with the threaded holes 11*b*.

Connecting bolts 16 are inserted through the flange 12*a* of the oil pan 12 and the upper resilient member 13 into the threaded holes 11*b* on the flange 11*a*. Between the head of each bolt 16 and the flange 12*a*, there is disposed a cylindrical lower resilient member 14 and a depressing disc 15 so that the resilient members 13 and 14 are compressed by tightening the bolts 16. The bolt hole 12*b* on the oil pan flange 12*a* has a diameter larger than the diameter of the shank of the bolt 16, while the resilient members 13 and 14 have bolt holes 13*a* and 14*a* of which diameters are slightly smaller than or substantially equal to the diameters of the bolt shank.

The flange 12*a* on the oil pan 12 is formed between each two adjacent bolt holes 12*b* with a hole 12*c* and the upper resilient member 13 has locating projections 13*b* for cooperation with the holes 12*c*. The projection 13*b* has a diameter slightly larger than the diameter of the hole 12*c* in the flange 12*a* and is engaged with the hole 12*c* so that the upper resilient member 13 is constrained against radial and circumferential displacement.

The lower resilient members 14 have an overall coefficient of resiliency which is 2 to 4 times as great as that of the upper resilient member 13. As in the previous embodiments, the bolt 16 has a threaded portion 16*a* of a predetermined length so that an appropriate compression is applied to the resilient members simply by tightening the bolt.

In assembling the oil pan 12 on the cylinder block 11, the projections 13*b* on the upper resilient member 13 are at first engaged with the locating holes 12*c* in the oil pan flange 12*a* so that the member 13 is secured to the upper surface of the flange 12*a* and then the lower resilient member 14 and the plate 15 are placed beneath the oil pan flange 12*a* at each of the bolt holes 12*b*. Thereafter, the bolt 16 is inserted through each plate 15 and each resilient member 14 into each bolt hole 12*b* and then through the upper resilient member 13 into each threaded holes 11*b* in the cylinder block flange 11*a*.

By tightening the bolts 16, the upper resilient member 13 and the lower resilient members 14 are appropriately compressed. Since the bolt holes 13*a* and 14*a* in the resilient members 13 and 14 have diameters slightly smaller than or substantially equal to the diameter of the bolt shank while the bolt hole 12*b* in the oil pan flange 12*a* has a larger diameter than the bolt shank, there is retained a radial clearance 17 between each of the bolts 16 and the bolt hole 12*b*. Further, since the upper resilient member 13 is constrained against radial and circumferential displacement, the clearance 17 can be maintained during the operation. The clearance 17 may be decreased when a deformation is produced in the upper resilient member 13, however, by determining the initial value of the clearance 17 at an appropriate value, it is possible to avoid any direct contact between the oil pan flange 12*a* and the connecting bolts 16.

Further, since the lower resilient members 14 have the overall coefficient of elasticity which is 2 to 4 times as great as that of the upper resilient member 13, any compressive deformation of the resilient members 13 and 14 under the static and dynamic loads on the oil pan can sufficiently be decreased so that it is possible to ensure adequate resiliency in both vertical and horizontal directions simultaneously providing a satisfactory sealing property.

It should be noted that the upper surface of the flange 12*a* is important in ensuring the oil-tightness and an increase in the clearance 17 causes a corresponding decrease in the sealing surface. Therefore, it is recommendable to determine the clearance as small as possible provided that the directed contact between the bolts and the oil pan flange 12*a* can be avoided.

In the illustrated embodiment, the upper resilient member 13 is secured to the flange 12*a* of the oil pan 12, however, it is possible to fix the lower resilient members 14 with respect to the flange 12*a*.

The present invention has thus been shown and described with reference to specific embodiments, however, it should be noted that the invention is in no way limited to the details of the illustrated structures but changes and modifications may be made without departing from the scope of the appended claims.

I claim:

1. Internal combustion engine including an engine body having a lower end defined by a periphery, an oil pan having a periphery connected with the periphery of the engine body by means of a plurality of connecting bolts inserted through the oil pan into the engine body with bolt heads located beneath the oil pan, first resilient means disposed between the engine body and the oil pan and extending along said peripheries, individual second resilient means disposed about each bolt between the oil pan and a respective individual depressing plate means, the first resilient means, the oil pan, the second resilient means, and the depressing plate means being disposed between the engine body and the heads of the connecting bolts and having compressive pressure applied thereto by the connecting bolts, said second resilient means having coefficient of elasticity 2 to 4 times as great as that of the first resilient means so that compressive deformation of the second resilient means under load on the oil pan can be decreased and the depressing plate means having an upwardly bent edge, so that said second resilient means is held in position by said edge.

2. Internal combustion engine in accordance with claim 1 in which said second resilient means is comprised of a single resilient member extending along the periphery of the oil pan.

3. Internal combustion engine in accordance with claim 1 in which at least one of the first and second resilient means is fixed to the periphery of the oil pan, each of the connecting bolts being passed through the oil pan through a bolt hole which is larger in diameter than the bolt so that a radial clearance is maintained between the bolt and the bolt hole, said one resilient means having bolt holes for passing the connecting bolts with close contact therewith.

4. Internal combustion engine in accordance with claim 3 in which said one resilient means is provided with projection means which is engaged with locating hole means provided in the oil pan for fixing said one resilient member to the oil pan.

5. Internal combustion engine in accordance with claim 1 which said second resilient means is comprised of a plurality of resilient members, each being disposed between each bolt head and the periphery of the oil pan.

6. Internal combustion engine in accordance with claim 4 in which said one resilient means is the first resilient means.

* * * * *